US007982681B2

(12) United States Patent
Chang et al.

(10) Patent No.: US 7,982,681 B2
(45) Date of Patent: Jul. 19, 2011

(54) LEAKY-WAVE DUAL-ANTENNA SYSTEM

(75) Inventors: Chi-Ho Chang, Sanxia Town (TW); Feng-Ling Liu, Longtan Shiang (TW); Pei-Ji Yang, Taoyuan (TW); Min-Fang Lo, Zhongli (TW)

(73) Assignee: Chung-Shan Institute of Science and Technology Armaments Bureau, Ministry of National Defense, Taoyuan County (TW)

( * ) Notice: Subject to any disclaimer, the term of this patent is extended or adjusted under 35 U.S.C. 154(b) by 413 days.

(21) Appl. No.: 12/339,023

(22) Filed: Dec. 18, 2008

(65) Prior Publication Data

US 2010/0156740 A1 Jun. 24, 2010

(51) Int. Cl.
*H01Q 11/00* (2006.01)
*H01Q 21/00* (2006.01)

(52) U.S. Cl. ..... 343/843; 343/853; 343/860

(58) Field of Classification Search ..... 343/843, 343/850, 853, 860

See application file for complete search history.

(56) References Cited

U.S. PATENT DOCUMENTS 5,313,218 A * 5/1994 Busking ..... 343/727
7,098,863 B2 * 8/2006 Bancroft ..... 343/859

* cited by examiner

*Primary Examiner* — Tan Ho

(57) ABSTRACT

The invention discloses a leaky-wave dual-antenna system comprising a transmitting antenna array and a receiving antenna array. The transmitting antenna array comprises plural first microstrips and plural corresponding first differential circuits, and each of the first differential circuit matches the corresponding first microstrip by a L-type matching network; the receiving antenna array comprises plural second microstrips and plural corresponding second differential circuits, and each of the second differential circuit matches the corresponding second microstrip by a L-type matching network. A first end and a second end of each of the first differential circuits are respectively connected to the corresponding first microstrip; a third end and a fourth end of each of the second differential circuits are respectively connected to the corresponding second microstrip.

5 Claims, 11 Drawing Sheets

LEAKY-WAVE DUAL-ANTENNA SYSTEM

BACKGROUND OF THE INVENTION

1. Field of the Invention

The present invention relates generally to a dual-antenna system, and more particularly, the present invention relates to a leaky-wave dual-antenna system which can improve the mutual coupling S21, or isolation between antennas.

2. Description of the Prior Art

A conventional frequency-modulated continuous-wave (FM-CW) radar uses a single-antenna with a circulator or a dual-antenna structure to isolate the leakage power between transmitting and receiving ends. Furthermore, a leaky-wave type antenna with differential input could be used to further enhance the isolation effect. In the single antenna with a circulator design, the isolation between transmitting and receiving end is around −35 dB, and amplifiers can not be used between antenna and circulator. Also, the impedance mismatch between antenna and circulator will also result in more signal leakage. A dual-antenna structure has advantages of better isolation, however, will need more antenna area.

For example, a small leaky-wave antenna system 1 in FIG. 1 has only one transmitting and one receiving antenna element. The radiation field of a single element transmitting antenna 10 is illustrated in FIG. 2. As the beam width is too large, part of the energy radiated by the transmitting antenna 10 will be coupled directly to the nearby receiving antenna 12, and will degrade the receiver sensitivity. The mutual coupling S21 of the leaky-wave antenna system in FIG. 1 is simulated and shown in FIG. 3. The mutual coupling S21 could be defined as $20*\log(V_2/V_1)$, wherein $V_1$ is an input voltage of the input end 100 of the transmitting antenna 10, $V_2$ is an output voltage of the output end 120 of the receiving antenna 12. Generally, $V_2$ is smaller than $V_1$, so the coupling quantity S21 is a negative value. The maximum coupling factor represents the maximum energy, under the operating frequency band, which will be received by the receiving antenna via the coupling path of the transmitting antenna, and it is the smaller the better. As shown in FIG. 3, the coupling factor S21 under the operating frequency A1 (about 5.3 GHz~5.4 GHz) of a conventional leaky-wave dual-antenna system 1 is greater than −30 dB, and the maximum coupling quantity is approximately −20 dB, which implies the leakage (coupling) between the transmitting antenna 10 and the receiving antenna 12 is too large.

Accordingly, the present invention provides a leaky-wave dual-antenna system which can reduce the maximum coupling factor under the operating frequency band to improve the leakage performance of an FMCW radar system.

SUMMARY OF THE INVENTION

An aspect of the present invention is to provide a leaky-wave dual-antenna system for reducing the maximum coupling factor between the transmitting antenna and the receiving antenna by means of an L-type matching network of matching the microstrips and the differential circuits, and also plural microstrip antennas with different lengths, which improves the mutual coupling S21 of the leaky-wave dual-antenna system.

According to an embodiment, the invention discloses a leaky-wave dual-antenna system comprising a transmitting antenna array and a receiving antenna array. The transmitting antenna array comprises plural first microstrips and plural corresponding first differential circuits, and each of the first differential circuit matches the corresponding first microstrip by an L-type matching network; the receiving antenna array comprises plural second microstrips and plural corresponding second differential circuits, and each of the second differential circuit matches the corresponding second microstrip by an L-type matching network.

A first end and a second end of each of the first differential circuits are respectively connected to the corresponding first microstrip, and a signal phase difference between the first end and the second end is 180°; a third end and a fourth end of each of the second differential circuits are respectively connected to the corresponding second microstrip, and a signal phase difference between the third end and the fourth end is 180°.

Furthermore, the leaky-wave dual-antenna system of the invention further comprises a first power divider and a second power divider, wherein the first power divider is connected and matched to the plural first differential circuits correspondingly, and the second power divider is connected and matched to the plural second differential circuits correspondingly.

According to another embodiment, the length of each of the plural first microstrips is different, and the length of each of the plural second microstrips is different. The leaky-wave dual-antenna system of the invention is located in a medium (such as air), the length difference between two adjacent first microstrips next to each other and the length difference between two adjacent second microstrips next to each other are all shorter than $\lambda_g/2$, wherein $\lambda_g=\lambda_0/(\epsilon_g)^{1/2}$, $\lambda_g$ is the wave length of the electromagnetic wave in the medium, $\lambda_0$ is the wave length of the electromagnetic wave in a vacuum, and $\epsilon_g$ is the dielectric constant of the medium. Thereby, the plural microstrips with different lengths (namely, the load impedances of the plural microstrips are mismatching) make the corresponding frequency of the maximum coupling quantity under the operating frequency band shift to a further higher frequency (deviate from the operating frequency band) and stagger the corresponding frequency of the maximum radiation energy approximately equal to the operating frequency band, to reduce the maximum coupling factor under the operating frequency band.

In summary, the transmitting antenna array and the receiving antenna array of the present invention are constituted by plural leaky-wave antennas respectively to improve the gain of the antenna and reduce the coupling factor between the transmitting antenna array and the receiving antenna array. Furthermore, the corresponding frequency of the maximum coupling quantity is shifted to a slightly higher frequency by means of an L-type matching network of the differential circuits and the microstrips. Furthermore, the corresponding frequency of the maximum coupling quantity is shifted to an even higher frequency by means of the microstrips with different lengths to stagger the corresponding frequency of the maximum radiation energy. In other words, the main purpose of the leaky-wave dual-antenna system is to shift the corresponding frequency of the maximum coupling factor under the operating frequency band to a further higher frequency (deviate from the operating frequency band) and stagger the corresponding frequency of the maximum radiation energy (approximately equal to the operating frequency band) to reduce the maximum coupling factor under the operating frequency band, namely, to improve the mutual coupling S21 of the leaky-wave dual-antenna system. Moreover, the design of the antenna with different lengths of the present invention can not only reduce the coupling effect of the antenna system in a confined space, but also allow more antenna elements to be installed in a confined space to improve the gain of the antenna.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 4A:
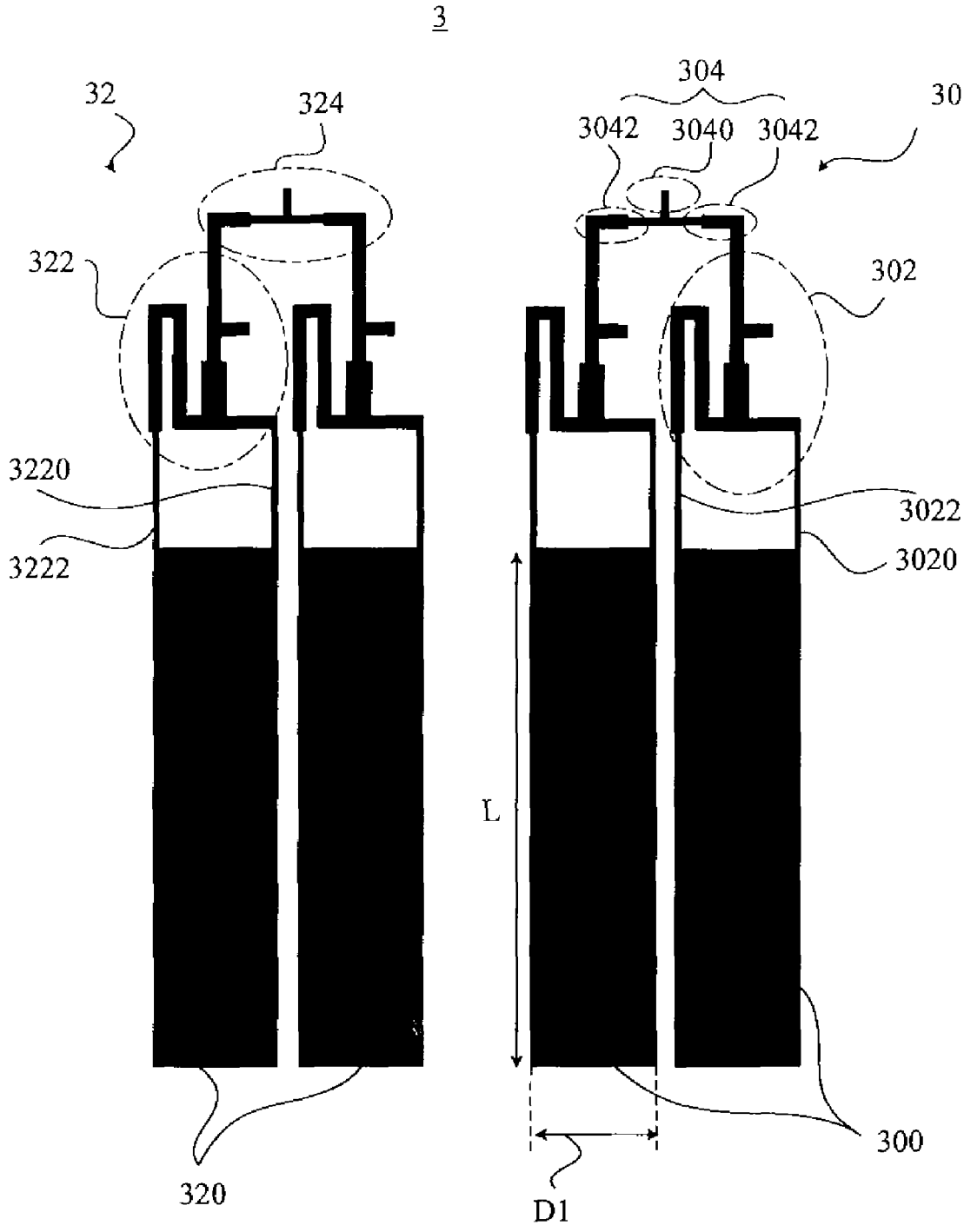
FIG. 4A illustrates a leaky-wave dual-antenna system according to the first embodiment of the present invention.

FIG. 4A illustrates a leaky-wave dual-antenna system 3 according to the first embodiment of the present invention. As illustrated in FIG. 4A, the leaky-wave dual-antenna system 3 of the invention comprises a transmitting antenna array 30 and a receiving antenna array 32. The transmitting antenna array 30 is used for transmitting an electromagnetic wave to a detection target. The transmitting antenna array 30 comprises two first microstrips 300 and two corresponding first differential circuits 302, and each of the first differential circuit 302 matches the corresponding first microstrip 300 by an L-type matching network. The receiving antenna array 32 is for receiving the reflected electromagnetic wave after transmitted by the transmitting antenna array 30 to the detected target. The receiving antenna array 32 comprises two second microstrips 320 and two corresponding second differential circuits 322, and each of the second differential circuit 322 matches the corresponding second microstrip 320 by an L-type matching network.

Each of the first differential circuits 302 comprises a first end 3020 and a second end 3022 which are respectively connected to the corresponding first microstrip 300. A signal phase difference between the first end 3020 and the second end 3022 is 180°, namely, the first differential circuit 302 could differentially output signals to the first microstrip 300. Each of the second differential circuits 322 comprises a third end 3220 and a fourth end 3222 which are respectively connected to the corresponding second microstrip 320. A signal phase difference between the third end 3220 and the fourth end 3222 is 180°, namely, the second differential circuit 322 could differentially output signals to the second microstrip 320. In other words, the design of the first differential circuit 302 meets the need of differentially outputting to excite the transmitting antenna array 30 to transmit a leaky electromagnetic wave to a detected target; the design of the receiving antenna array 32 could receive a leaky electromagnetic wave reflected from the detected target.

Figure 4B:
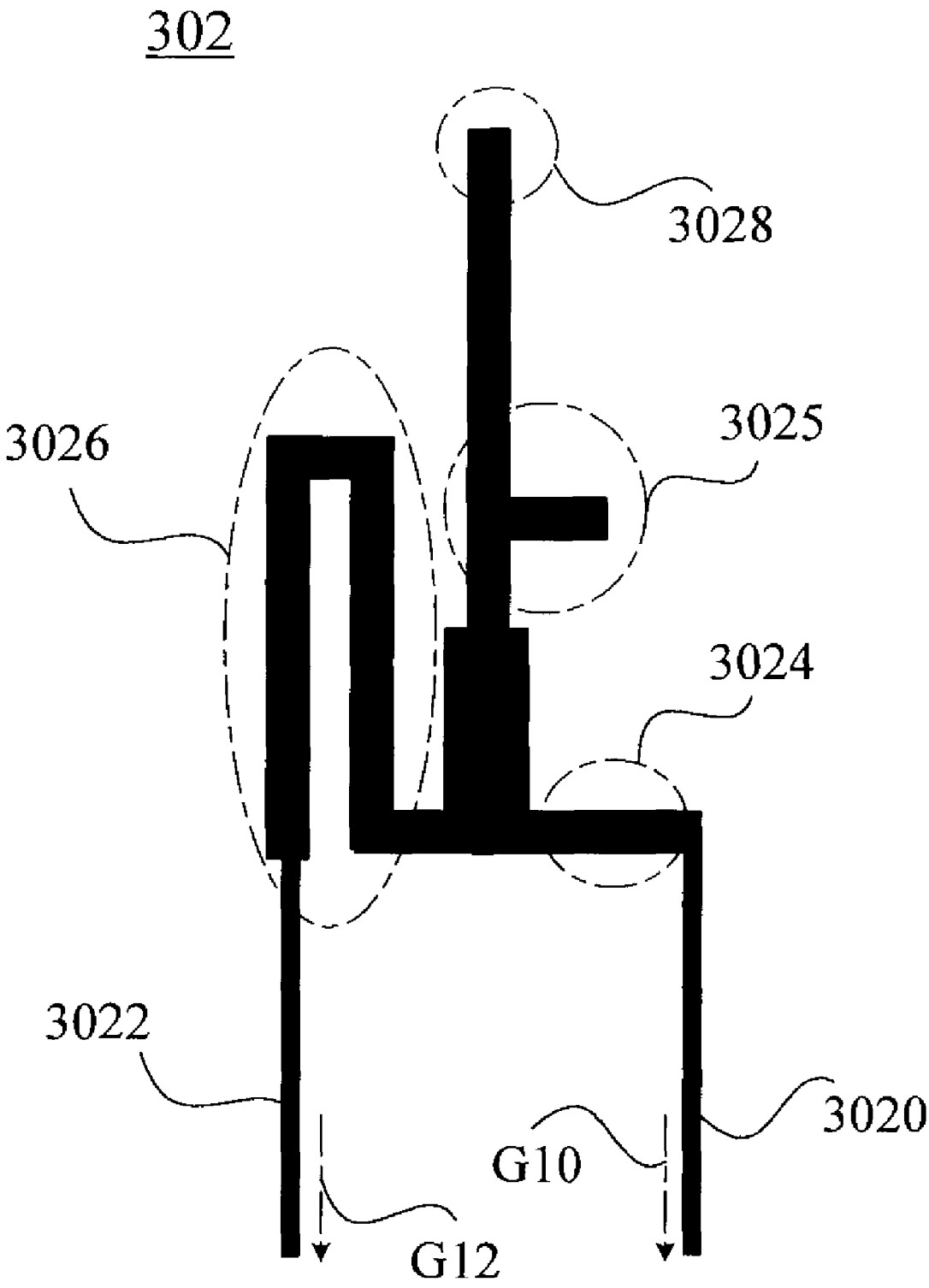
FIG. 4B illustrates the first differential circuit in FIG. 4A.
Figure 5:
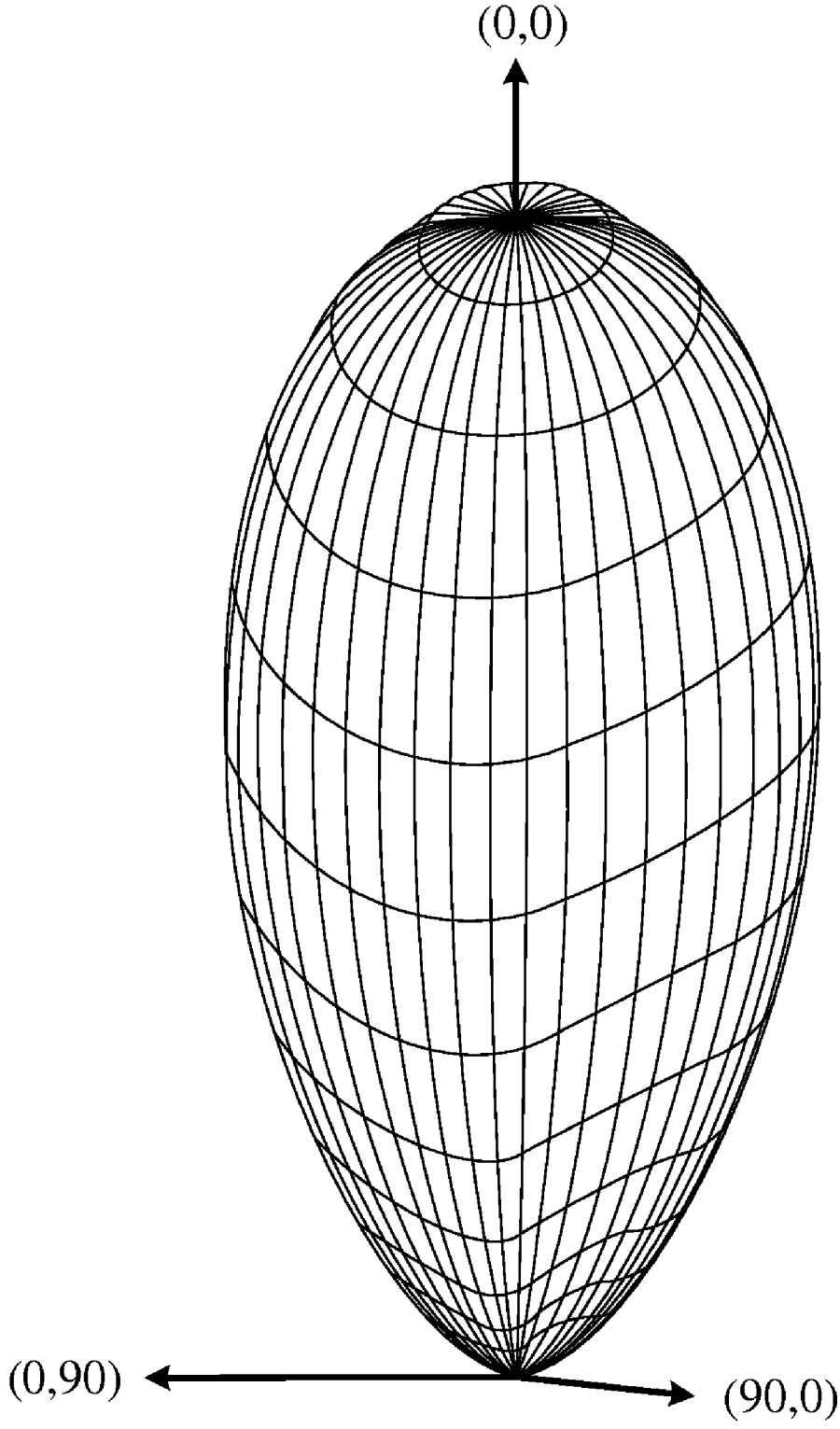
FIG. 5 is the radiation pattern of the transmitting antenna array in FIG. 4A.

Owing to the structure of each first differential circuit 302, the structure of each second differential circuit 322 is completely the same, only the details about the structure of the first differential circuit 302 are described as follows. As shown in FIG. 4B, the first differential circuit 302 comprises a fed area 3028, a first impedance area 3024, a second impedance area 3026, a third impedance area 3025, the first end 3020 and the second end 3022. After the first differential circuit 302 receives signals from the fed area 3028, the signals are divided into a first sub-signal G10 and a second sub-signal G12, which pass through the first impedance area 3024 and the second impedance area 3026 respectively. Due to the different route and the length design of the second impedance area 3026 and the first impedance area 3024, the first impedance area 3024 and the second impedance area 3026 have different load impedances. The purpose of the different load impedances is to generate a phase difference of 180° between the first sub-signal G10 through the first impedance area 3024 and the second sub-signal G12 through the second impedance area 3026 to meet the requirement of differentially outputting of the first differential circuit 302.

Figure 2:
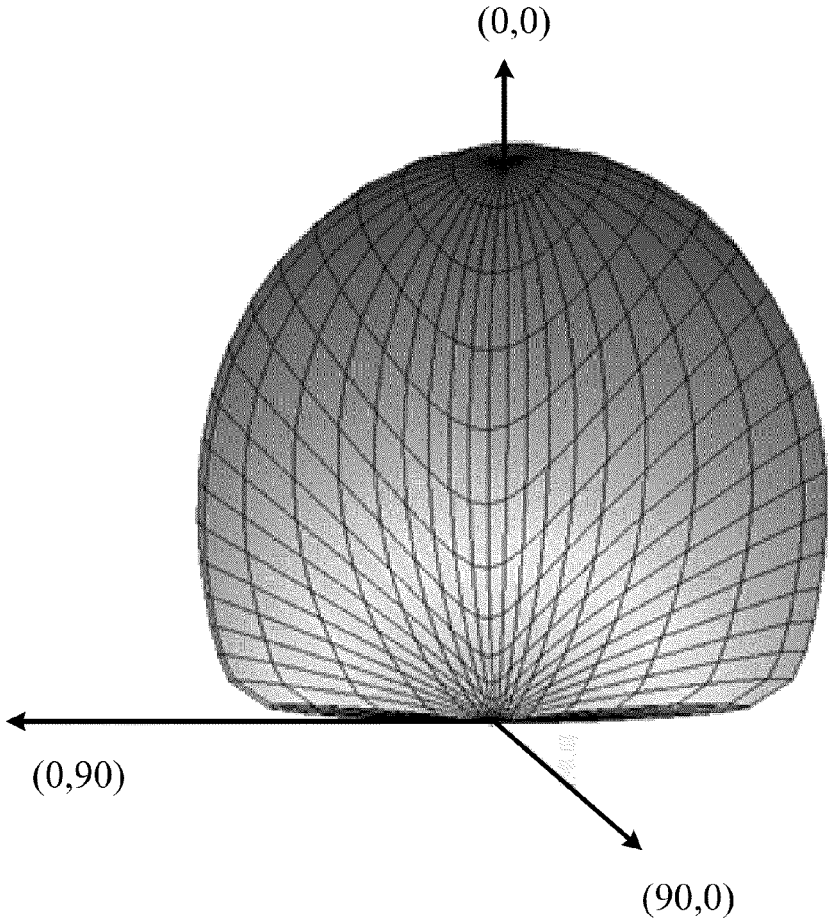
FIG. 2 (Prior Art)
FIG. 2 is a field distribution graph showing the radiation field of the transmitting antenna in FIG. 1.

According to the antenna theory, when the length of a leaky-wave antenna is longer, the gain is larger. The number of a one-dimensional leaky-wave antenna array (such as the transmitting antenna array 30 shown in FIG. 4A) affects mainly the radiation field distribution in different azimuth angles, while the length of a leaky-wave antenna affects mainly the radiation field distribution in different elevation angles. To improve the gain and directivity of the antenna and narrow the width of the beam, a power divider could be collocated with plural single-leaky-wave antennas to become one-dimensional antenna array. A first power divider 304 of the present invention combines two first differential circuits 302 and two first microstrips 300 to become the transmitting antenna array 30. Similarly, a second power divider 324 of the present invention combines two second differential circuits 322 and two second microstrips 320 to become the receiving antenna array 32. Compared to the beam width (as shown in FIG. 2) of the radiation field of conventional leaky-wave antenna system 1, the beam width of the radiation field of the leaky-wave dual-antenna system 3 of the present invention is smaller. Accordingly, the coupling quantity S21 between the transmitting antenna array 30 and the receiving antenna array 32 could be reduced.

Figure 1:
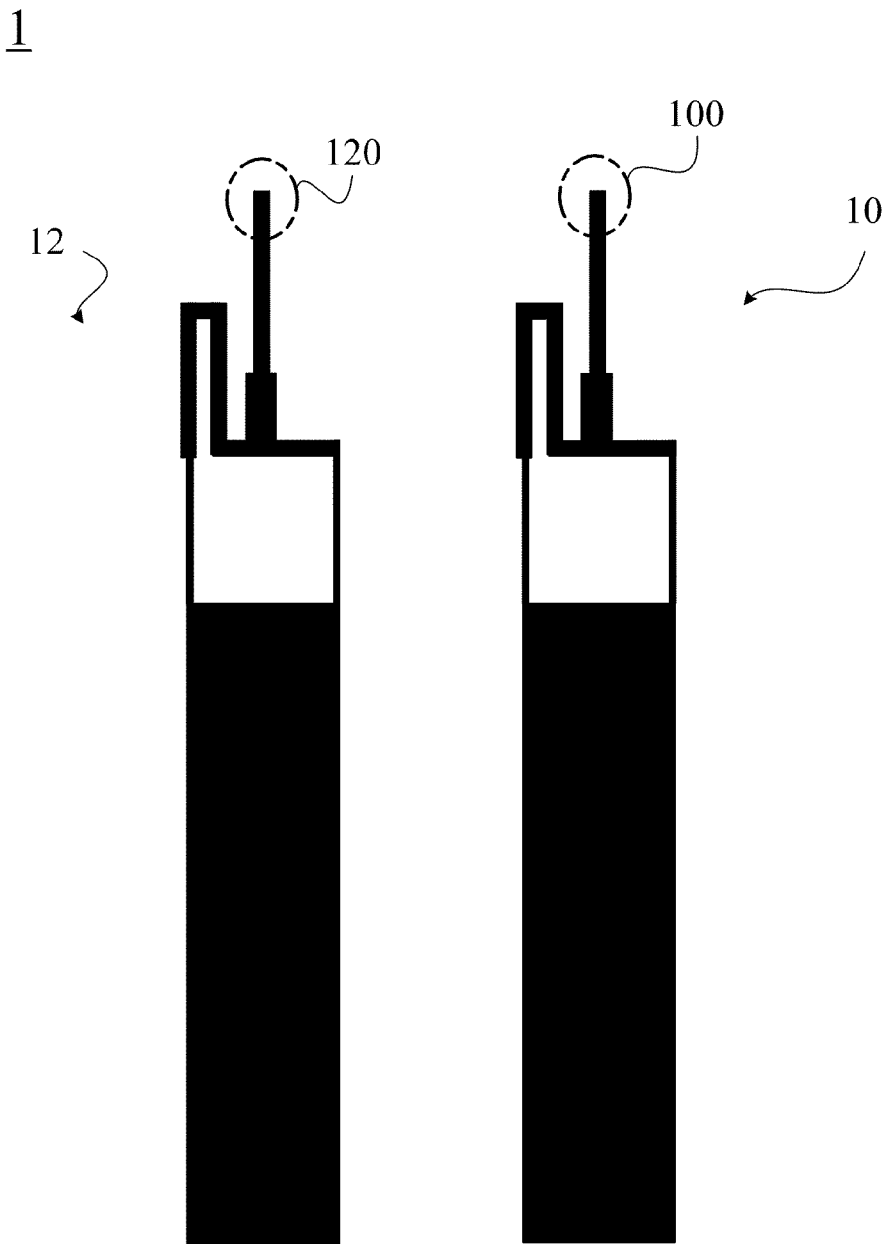
FIG. 1 (Prior Art)
FIG. 1 illustrates a conventional leaky-wave antenna system.

Furthermore, compared to the conventional leaky-wave antenna system 1 (as illustrated in FIG. 1), each of the first differential circuits 302 of the leaky-wave dual-antenna system 3 of the present invention has a third impedance area 3025 (as shown in FIG. 4B), the purpose of the third impedance area 3025 is to make the first differential circuit 302 match the first microstrip 300 by an L-type matching network to make the corresponding frequency of the maximum mutual coupling S21 shift to higher frequency and also to stagger the corresponding frequency of the maximum radiation energy. Additional remarks, for a conventional antenna, the corresponding frequency of the maximum radiation energy is related to the length of the microstrip. As for a leaky-wave antenna, the corresponding frequency of the maximum radiation energy is related to the distance between the differential inputting end (the width D1 of the microstrip), but not the length L of the microstrip. Accordingly, the structural improvement of the present invention is for shifting the corresponding frequency of the maximum mutual coupling but not shifting the corresponding frequency of the maximum radiation energy.

For example, in the leaky-wave dual-antenna system 3 in FIG. 4A, the radiation energy of the transmitting antenna array 30 may be partially absorbed by receiving antenna array 32, besides, the reflected radiation energy may not be transmitted out due to the mismatch of impedance caused by the circuit design of the transmitting antenna array 30. Generally, a reflected coefficient S11 represents the ratio of the reflected radiation energy. The smaller the reflected coefficient S11 means the more radiation energy that could be transmitted out. To reduce the reflected coefficient S11 under the operating frequency band, impedance matching design is used on the antenna structure in the present invention. The first power divider 304 in FIG. 4A comprises a fed circuit 3040 and two impedance-matching circuits 3042 with the length of one fourth of the wave length $\lambda_g/4$, and the impedance-matching circuit 3042 are connected between the first differential circuit 302 and the fed circuit 3040. For example, the load impedance of the fed circuit 3040 is 50Ω; the load impedance of the impedance-matching circuit 3042 is $50*2^{1/2}$ (=70.7)Ω; and the load impedance of the first differential circuit 302 is 50Ω. The impedance-matching design of the power divider 304 and the first differential circuit 302 reduces reflected coefficient S11 of the leaky-wave dual-antenna system 3 under the operating frequency band (5.3 GHz~5.4 GHz), that is, improves the efficiency of radiation energy transmission.

Figure 7:
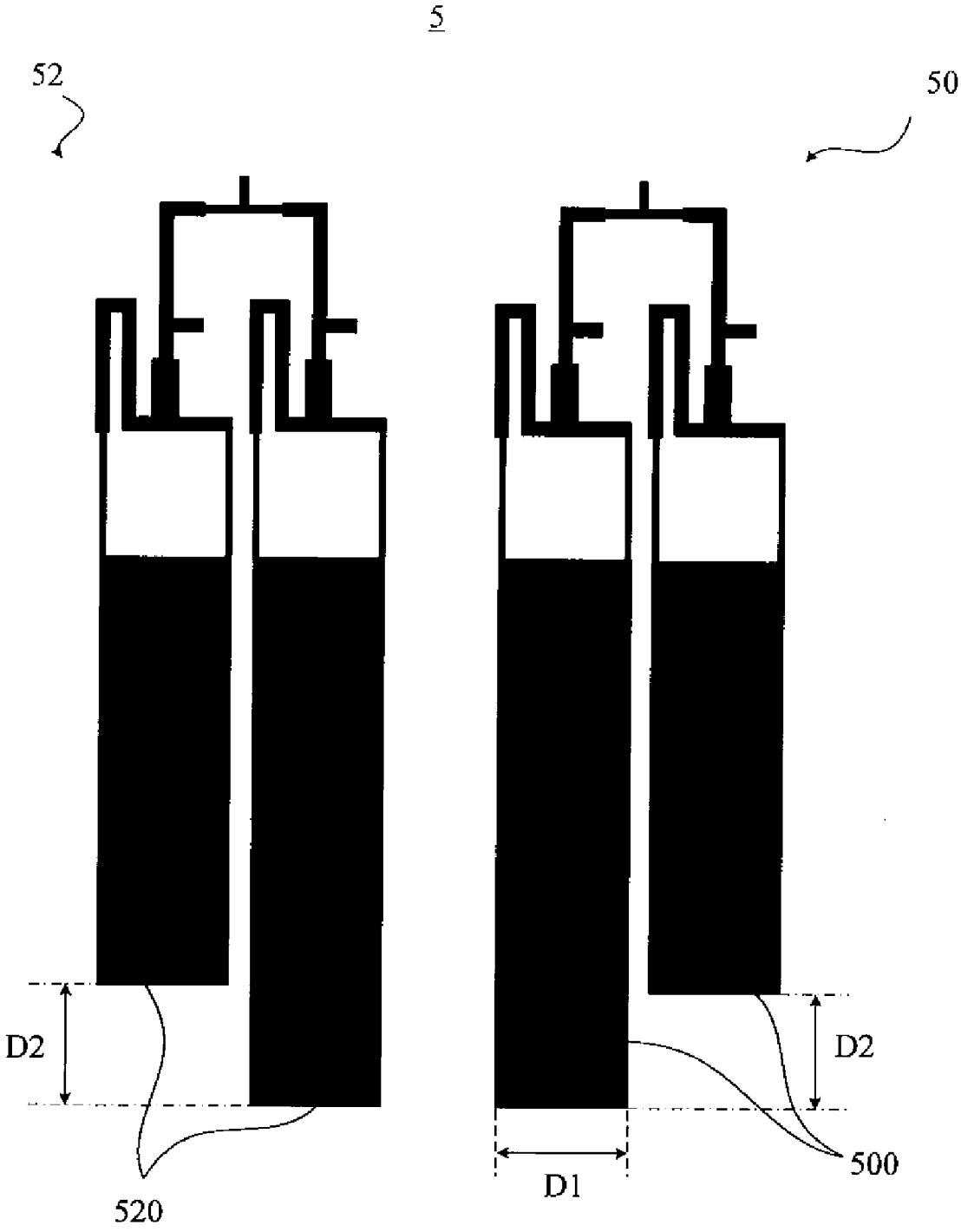
FIG. 7 illustrates a leaky-wave dual-antenna system according to the second embodiment of the present invention.

In the present invention, in addition to the structural design of the leaky-wave dual-antenna system 3 in FIG. 4A, there are still other structural improvements for further reducing the coupling factor. FIG. 7 illustrates a leaky-wave dual-antenna system 5 according to the second embodiment of the present invention. Compared to the leaky-wave dual-antenna system 3 in FIG. 4A, the transmitting antenna array 50 of the leaky-wave dual-antenna system 5 in FIG. 7 has two first microstrips 500 with different lengths, and the receiving antenna array 52 also has two second microstrips 520 with different lengths. In the second embodiment, the length difference D2 of the two first microstrips are shorter than half of the wave length in a medium ($\lambda_g/2$), and the length difference D2 of the two second microstrips is also shorter than half of the wave length in a medium ($\lambda_g/2$), wherein $\lambda_g=\lambda_0/(\epsilon_g)^{1/2}$, $\lambda_g$ is the wave length of the electromagnetic wave in the medium, $\lambda_0$ is the wave length of the electromagnetic wave in a vacuum, and $\epsilon_g$ is the dielectric constant of the medium. Moreover, the microstrips with different lengths are more suitable for accommodated in a non-rectangular space. For example, compared to the leaky-wave dual-antenna system 3 in FIG. 4A and the conventional leaky-wave antenna system 1 in FIG. 1, the leaky-wave dual-antenna system 5 in FIG. 7 could be more adequately fit a round space and also meet the requirement of reducing the mutual coupling under the operating frequency band.

Figure 8:
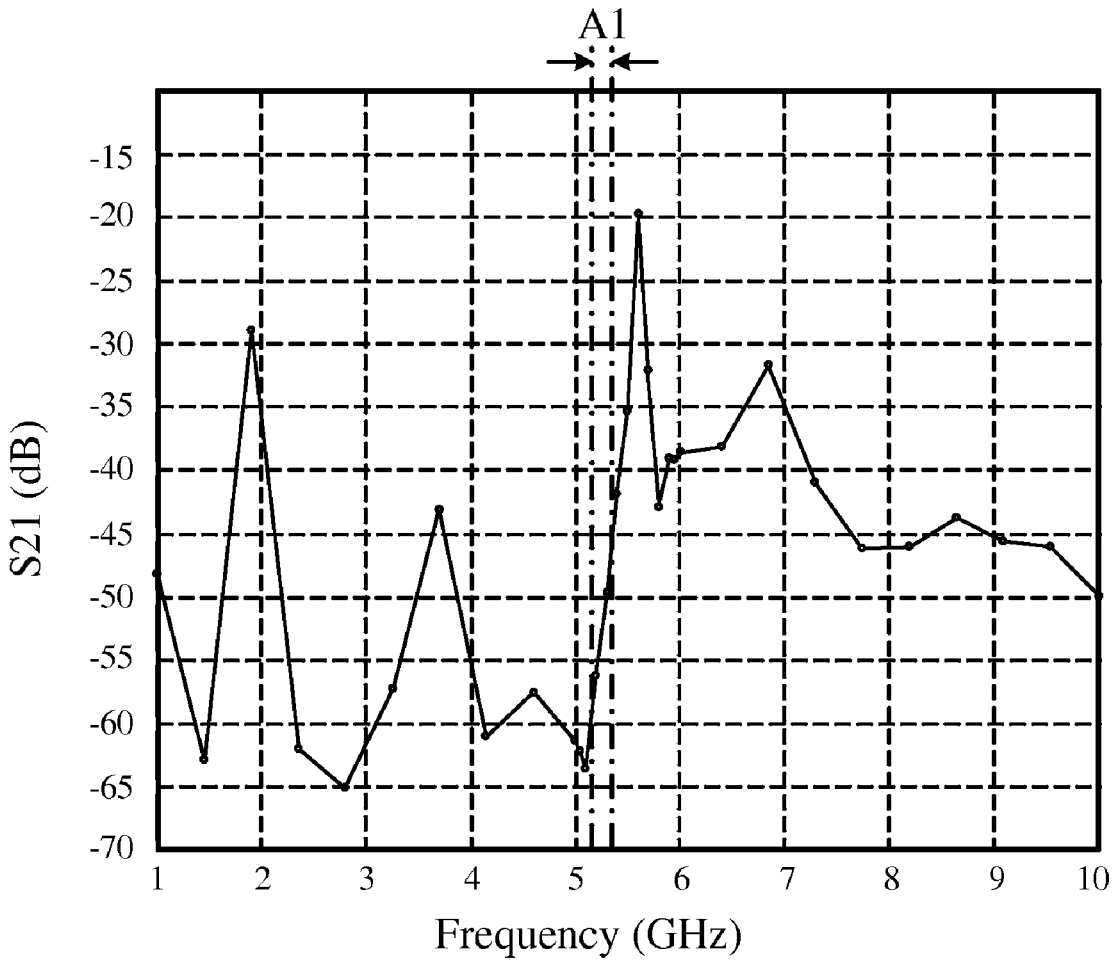
FIG. 8 is a simulated result showing a coupling quantity S21 of the leaky-wave dual-antenna system in FIG. 7.
Figure 9A:
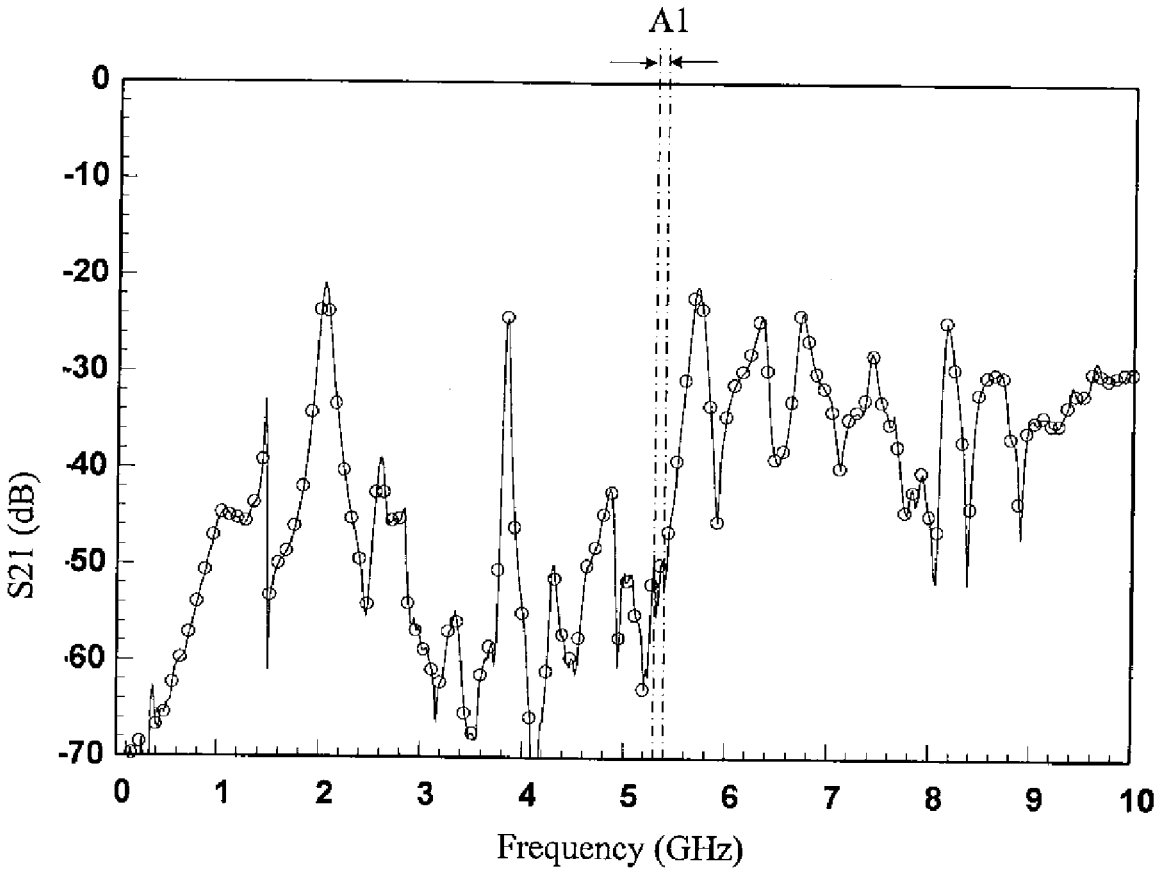
FIG. 9A is an experiment data showing the coupling quantity S21 of the leaky-wave dual-antenna system in FIG. 7.
Figure 9B:
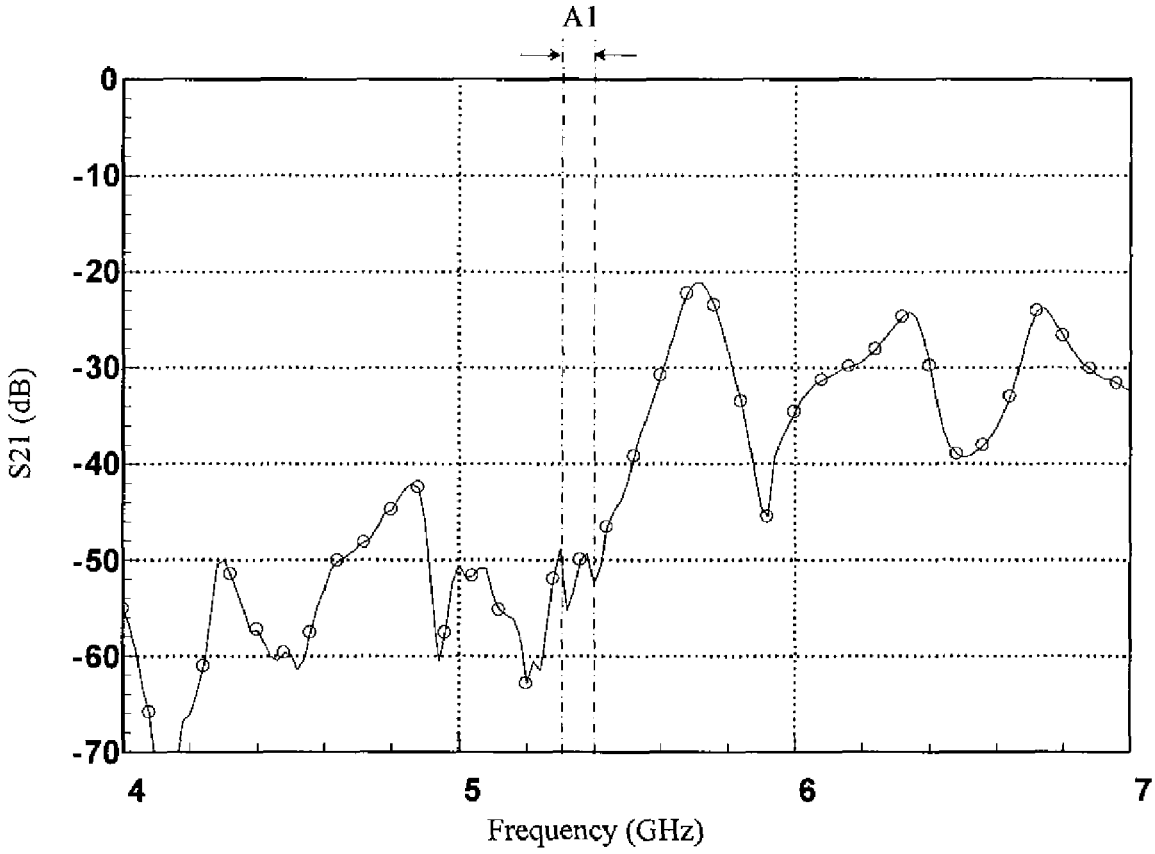
FIG. 9B is an experiment data showing the coupling quantity S21 under partial frequency band in FIG. 9A.

The length difference of the microstrips results in different load impedances. The present invention shifts the corresponding frequency of the maximum coupling S21 to a higher frequency (the shift is about 450 MHz) by means of the impedance mismatch design of the microstrips to reduce the maximum coupling S21 under the operating frequency band A1 to −45 dB, as shown in FIG. 8. Please refer to FIG. 9A and FIG. 9B. FIG. 9A is experimental data showing the coupling factor S21 of the leaky-wave dual-antenna system in FIG. 7. FIG. 9B is an experiment data showing the coupling factor S21 under partial frequency band in FIG. 9A. Particularly, it is easy to see from the experimental data of the coupling quantity S21 in FIG. 9B that the maximum coupling under the operating frequency band A1 (5.3 GHz~5.4 GHz) is about −50 dB, which means the interference between the transmitting antenna array 50 and the receiving antenna array 52 of the leaky-wave dual-antenna system 5 of the present invention has been reduced considerably.

Figure 3:
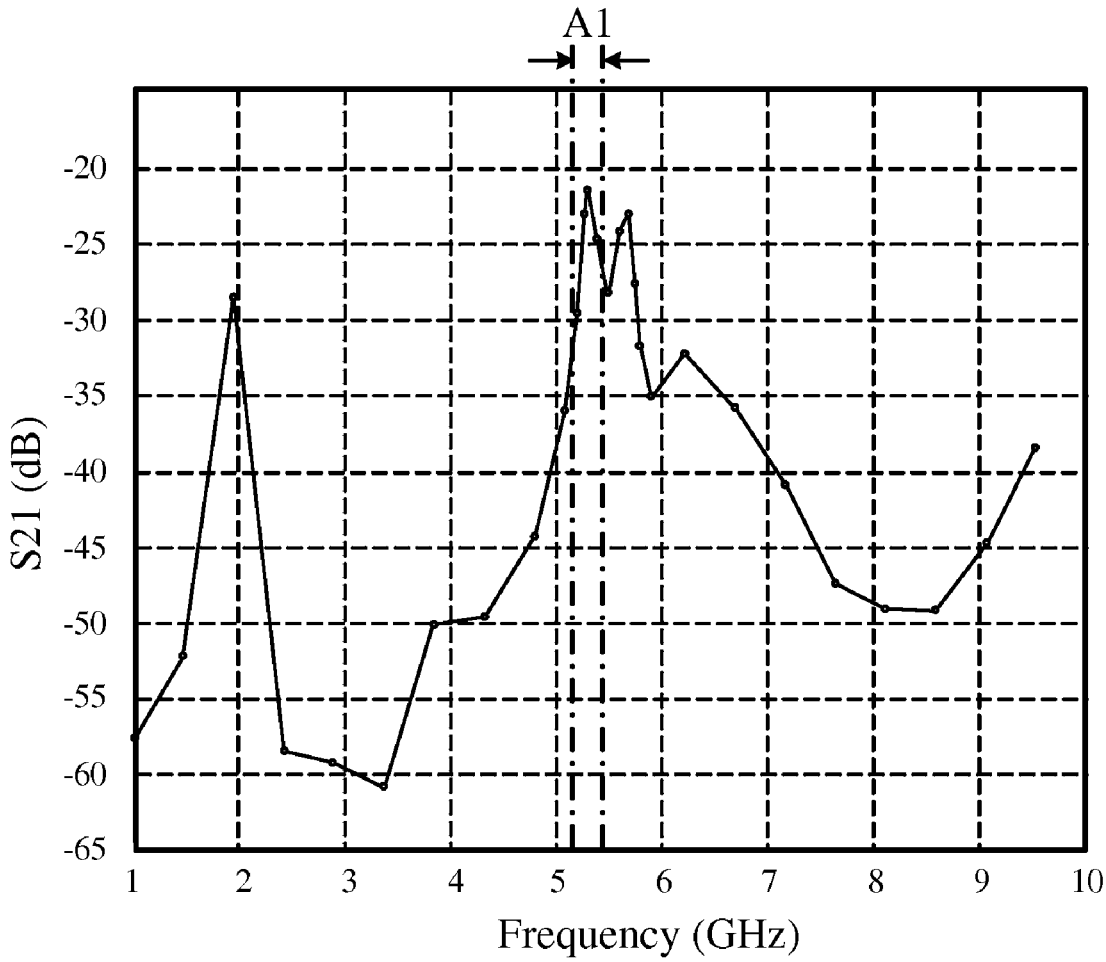
FIG. 3 is a simulated result showing a coupling factor S21 of the leaky-wave antenna system in FIG. 1.
Figure 6:
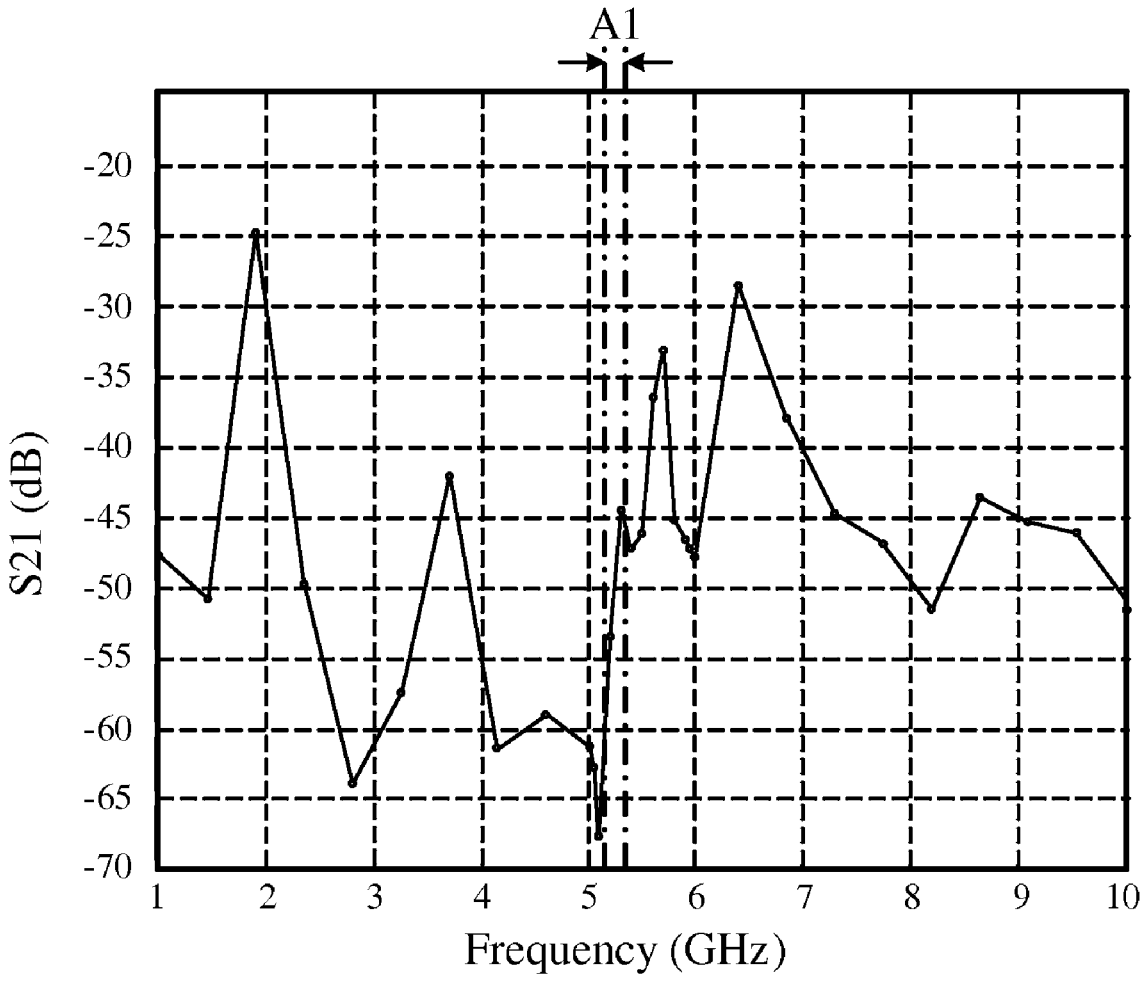
FIG. 6 is a simulated result showing a coupling factor S21 of the leaky-wave dual-antenna system in FIG. 4A.

FIG. 3, FIG. 6 and FIG. 8 are simulated results calculated by a commercial simulation software (IE3D). The calculating method adopts the Method-of-Moments (MoM). The base of the theory is to solve electromagnetic field equations by means of the electromagnetic field theory with the Green function and the boundary condition. Particularly, comparing the experimental data in FIG. 9A with the simulated graph in FIG. 8, it is seen that the experimental data is very close to the simulated graph, so that the simulated result of the coupling factor (FIG. 3, FIG. 6 and FIG. 8) provided by the present invention is reliable.

Although the transmitting antenna array and the receiving antenna array mentioned above are constructed by two leaky-wave antenna elements, actually an antenna array could be constructed by even more leaky-wave antenna elements. For example, both of a transmitting antenna array and a receiving antenna array could be constructed by four leaky-wave antenna elements. The number of the antenna elements depends on the system performance requirement, and also on the space constraints.

Compared to the prior art, the transmitting antenna array and the receiving antenna array of the present invention are constructed by plural leaky-wave antenna elements respectively to improve the gain of the antenna and reduce the mutual coupling between the transmitting antenna array and the receiving antenna array. Besides, the corresponding frequency of the maximum coupling quantity is shifted to a slightly higher frequency by means of an L-type matching network of the differential circuits and the microstrips. Furthermore, the corresponding frequency of the maximum coupling is shifted to an even higher frequency by means of the microstrips with different lengths to stagger the corresponding frequency of the maximum radiation energy. In other words, the main purpose of the leaky-wave dual-antenna system of the present invention is to shift the corresponding frequency of the maximum coupling under the operating frequency band to a further higher frequency (deviate from the operating frequency band) and stagger the corresponding frequency of the maximum radiation energy (approximately equal to the operating frequency band) to reduce the maximum coupling under the operating frequency band, namely, to improve the mutual coupling S21 of the leaky-wave dual-antenna system. Moreover, the design of the antenna with different lengths of the present invention can not only reduce the coupling effect of the antenna system in a confined space, but also allow more antenna elements to be installed in a confined space to improve the gain of the antenna.

Although the present invention has been illustrated and described with reference to the preferred embodiment thereof, it should be understood that it is in no way limited to the details of such embodiment but is capable of numerous modifications within the scope of the appended claims.

What is claimed is:

1. A leaky-wave dual-antenna system comprising:

a transmitting antenna array for transmitting an electromagnetic wave, comprising plural first microstrips and plural corresponding first differential circuits, wherein each of the first differential circuit matches the corresponding first microstrip by an L-type matching network, each of the first differential circuit comprises a first end and a second end which are respectively connected to the corresponding first microstrip, and a signal phase difference between the first end and the second end is 180°; and a receiving antenna array comprising plural second microstrips and plural corresponding second differential circuits, wherein each of the second differential circuit matches the corresponding second microstrip by an L-type matching network, each of the second differential circuit comprises a third end and a fourth end which are respectively connected to the corresponding second microstrip, and a signal phase difference between the third end and the fourth end is 180°.

2. The leaky-wave dual-antenna system of claim 1 further comprising a first power divider and a second power divider, wherein the first power divider is connected and matched to the plural first differential circuits correspondingly, and the second power divider is connected and matched to the plural second differential circuits correspondingly.

3. The leaky-wave dual-antenna system of claim 1, wherein the length of each of the plural first microstrips is different, and the length of each of the plural second microstrips is different.

4. The leaky-wave dual-antenna system of claim 3, wherein when the leaky-wave dual-antenna system is located in a medium, the length difference between two adjacent first microstrips next to each other and the length difference between two adjacent second microstrips next to each other are all shorter than $\lambda_g/2$, wherein $\lambda_g=\lambda_0/(\in_g)^{1/2}$, $\lambda_g$ is the wave length of the electromagnetic wave in the medium, $\lambda_0$ is the wave length of the electromagnetic wave in a vacuum, and $\in_g$ is the dielectric constant of the medium.

5. The leaky-wave dual-antenna system of claim 1, wherein when the leaky-wave dual-antenna system is located in a medium, the width of each first microstrip and the width of each second microstrip are all $\lambda_g/2$, wherein $\lambda_g=\lambda_0/(\in_g)^{1/2}$, $\lambda_g$ is the wave length of the electromagnetic wave in the medium, $\lambda_g$ is the wave length of the electromagnetic wave in a vacuum, and $\in_g$ is the dielectric constant of the medium.

* * * * *